United States Patent [19]

Waldhauser et al.

[11] 4,364,138

[45] Dec. 21, 1982

[54] AUTOMATIC FLOOR CLEANING MACHINE WITH REMOVABLE DRIVE CARRIAGE

[75] Inventors: Steven J. A. Waldhauser; Richard D. Masbruch, both of Lewiston, N.Y.

[73] Assignee: Wetrok, Inc., Niagara Falls, N.Y.

[21] Appl. No.: 206,301

[22] Filed: Nov. 12, 1980

[51] Int. Cl.[3] ..... A47L 11/18

[52] U.S. Cl. ..... 15/50 R; 15/83; 15/340

[58] Field of Search ..... 15/50 R, 50 C, 51, 52, 15/49 R, 49 C, 98, 320, 321, 340, 83-87, 49, 50, 82; 180/294, 298, 65

[56] References Cited

U.S. PATENT DOCUMENTS

| | | | |
|---|---|---|---|
| 3,277,511 | 10/1966 | Little et al. | 15/320 |
| 3,729,908 | 5/1973 | Miner | 15/320 |
| 3,842,927 | 10/1974 | Tantlinger | 180/295 |
| 3,879,789 | 4/1975 | Kasper | 15/320 X |

*Primary Examiner*—Edward L. Roberts

*Attorney, Agent, or Firm*—Christel, Bean & Linihan

[57] ABSTRACT

A floor cleaning machine having drive wheels, scrub brushes, and cleaning liquid applying and pick-up means. The machine has a drive train including a drive motor, a drive axle assembly and the drive wheels. The drive train is mounted on a removable carriage which is slidable laterally of the machine while the latter is in operating position, to provide access to the drive train for maintenance and repair.

9 Claims, 4 Drawing Figures

Fig. 1.
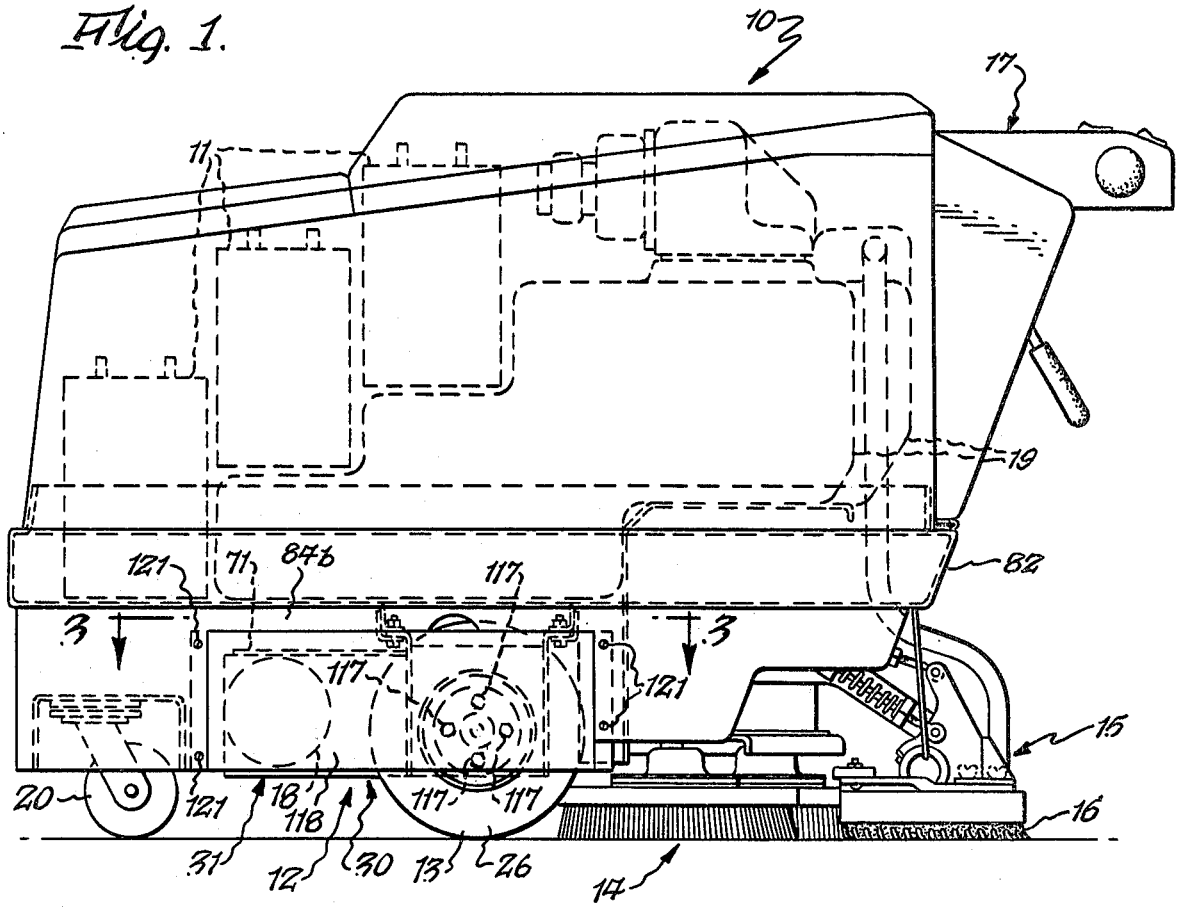
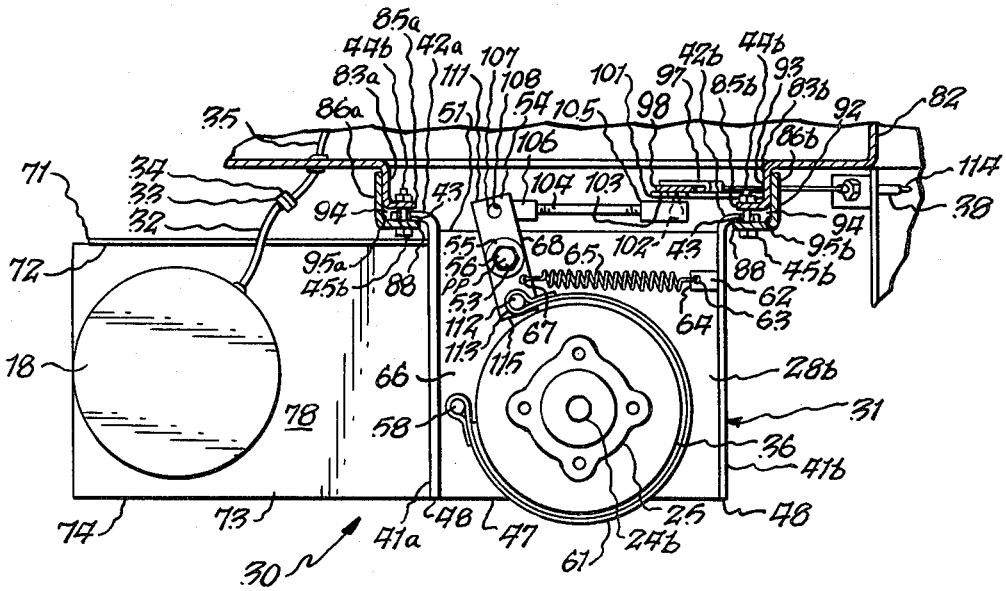
Fig. 2.

AUTOMATIC FLOOR CLEANING MACHINE WITH REMOVABLE DRIVE CARRIAGE

BACKGROUND OF THE INVENTION

This invention relates to floor cleaning machines adapted for wet scrubbing and vacuum drying of dirty floor surfaces, and more particularly to a new and improved automatic floor cleaning machine adapted for easy accessibility to and removal of driven train components for maintenance, repair and replacement of the same.

Known floor cleaning machines have drive trains essentially comprising a drive motor in operative connection with an axle assembly having a differential mechanism with aligned axle shafts operably connected thereto, and drive wheel assemblies mounted at opposite ends of the axle shafts. Typically, braking mechanisms are operatively associated with the drive wheel assemblies. Failure of any one of the drive train components results in the cleaning machine being taken out of service until the defective component is repaired or replaced. The time and effort required to accomplish such repair or replacement is a function of the design of the power train insofar as location of the components is concerned, and the manner in which they are attached to the chassis of the machine. Heretofore, it has been necessary either to raise the machine by means of a hoist or other method, or to tip the machine on its side to provide access to the component to be worked on. If the machines are to be tipped, removal of batteries and emptying of solution tanks and the like usually is required, which is both inconvenient and time consuming. In order to do this, it is often necessary to transport the machine from the location of its breakdown to a repair shop in another location. In addition, access to a particular portion of a particular component may be complicated by the lack of clearance between the component and the chassis and the fact that the drive train assembly as a whole is bolted directly to the chassis using brackets or other means. Even routine preventive maintenance of drive train components may require a great deal of time and effort and may therefore be ignored in favor of retaining the machine in service until a drive train component actually fails, the probability of which is increased when routine maintenance is not performed.

SUMMARY OF THE INVENTION

Accordingly, a primary object of the present invention is to provide a new and improved automatic floor cleaning machine having a drive train assembly adapted for ease of access thereto. To this end, the machine of the present invention incorporates a removable drive carriage supporting the entire drive train, and a chassis adapted for receiving the same.

Another object of the present invention is to provide such a machine having a removable drive carriage that may be removed or inserted while the machine is oriented in its normal operating position and that need be lifted only a sufficient distance away from the floor surface to provide the minimal clearance required for removal of the drive wheels.

A further object of the present invention is to provide such a removable drive carriage that is slidably supported by the chassis of the machine and which is securely mounted thereon for operation of the machine.

Yet another object of the present invention is to provide such a carriage that is adapted to support associated brake mechanisms as well as the drive train components.

An additional objective of the present invention is to provide the foregoing in an arrangement facilitating disconnection from associated components remaining on the machine.

The foregoing and additional objects, advantages and characterizing features of the present invention will become clearly apparent upon reading the following detailed description in conjunction with the accompanying drawings wherein like reference numerals and letters indicate like parts throughout the various views.

BRIEF DESCRIPTION OF THE FIGURES

FIG. 1 is a side elevational view of a floor cleaning machine having a removable drive carriage assembly of the present invention with hidden portions of the machine designated by dotted lines.

FIG. 2 is an enlarged, fragmentary side elevational view of the floor cleaning machine of FIG. 1 partially in section and with the tire and skirt removed.

DETAILED DESCRIPTION OF AN ILLUSTRATIVE EMBODIMENT

Figure 3:
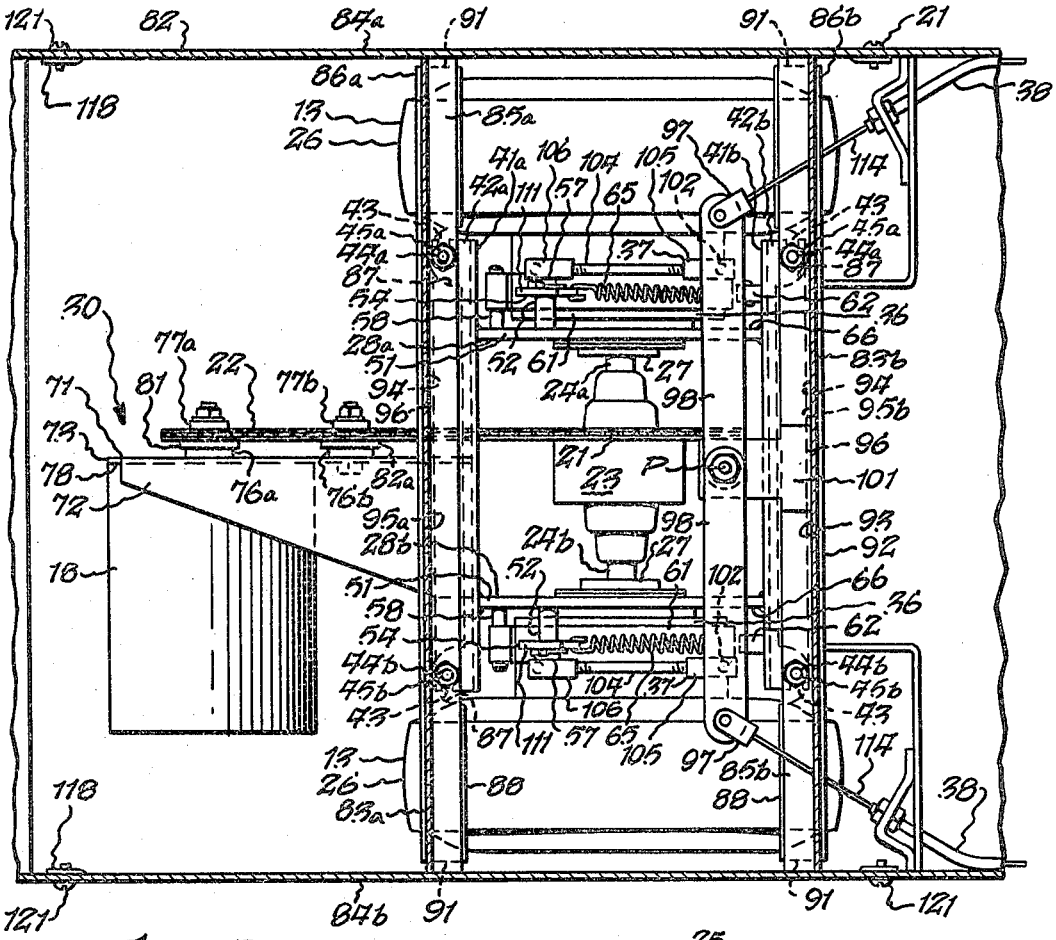
FIG. 3 is a sectional view taken about on line 3—3 of FIG. 1.

Referring now to the drawings, there is shown in FIG. 1 a floor cleaning machine 10 of the type having a power source 11 (shown as a plurality of storage batteries), propulsion means 12 connected to power source 11 including a pair of drive wheels 13 for tracking on the floor surface to be cleaned, scrubber means 14 for wetting and cleaning the surface, vacuum means 15 including a wiper or squeegee 16 for drying of and proper tracking on the cleaned surface, and control means 17 operatively associated with the propulsion means, the scrubber means and the vacuum means for controlling actuation of the device 10. Cleaning liquid dispensing and holding tanks 19 and casters 20 also are provided. Floor cleaning devices of this general type are well-known in the art, as illustrated by U.S. Pat. No. 3,277,511 entitled "Adjustable Width Floor Treating Machine" issued Oct. 11, 1966 to J. M. Little et al. The machine illustrated herein is of the type disclosed in pending U.S. application Ser. No. 186,420, filed Sept. 12, 1980 by Steven J. A. Waldhauser and Dennis J. Corneil, to which reference may be made for additional details, which application is assigned to the assignee of this application. In addition to illustrating basic features of such machine, FIG. 1 shows a preferred embodiment of the removable drive carriage arrangement of the present invention wherein the entire drive train is part of a removable drive carriage assembly 30.

As shown in FIG. 3 the drive train includes propulsion means 12 comprising an electric drive motor 18 connected to a driven sprocket 21 by drive chain 22. Driven sprocket 21 is carried by differential gear housing 23. Axle shafts 24*a*, 24*b* extend from opposite ends of housing 23, and identical hubs 25, carrying drive wheels 26 are mounted on the outer ends of axle shafts 24*a*, 24*b*. Shafts 24*a*, 24*b* are journaled in bearings 27 located in corresponding opposing end walls 28*a*, 28*b* of a carriage 31. Motor 18 is detachably connected to power source 11 by a power cable 32 connected to motor 18 and having a plug 33 for engaging socket 34 on another cable 35 connected to power source 11. Plug 33 and socket 34 provide a quick connect-disconnect between motor 18 and power source 11.

Brake assemblies 36, hereinafter described in detail, are associated with drive wheels 13 and each have a ball and socket quick connect-disconnect arrangement 37 of conventional design connecting brake assemblies 36 to brake lines 38.

Figure 4:
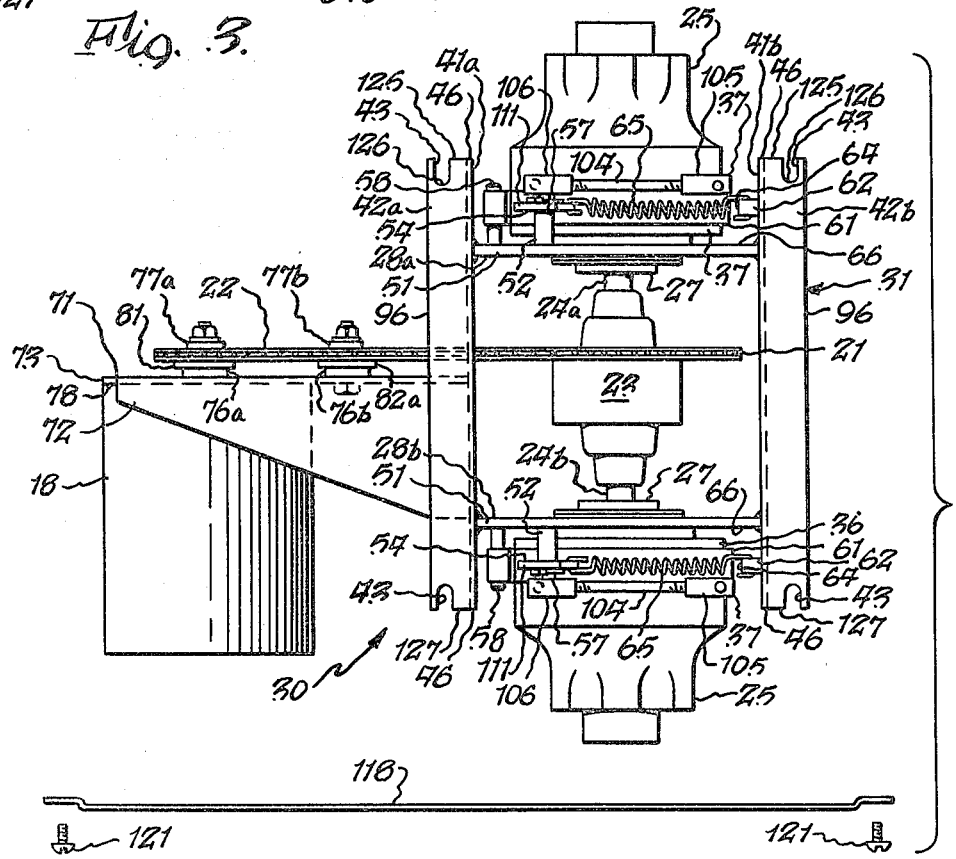
FIG. 4 is a top plan view showing the drive carriage assembly of the present invention removed from the floor cleaning machine and also showing the skirt removed from the machine.

Carriage 31 of removable drive carriage assembly 30 comprises a pair of parallel, opposed side walls 41*a*, 41*b*, the top ends of which are bent outwardly at a right angle as shown in FIG. 2 to form flanges 42*a*, 42*b*. Side wall 41*a* is slotted for passage of drive chain 22. As shown in FIGS. 3 and 4, flanges 42*a*, 42*b* have longitudinally extending open ended slots 43 at each end of suitable size to accommodate the shanks 44*a*, 44*b* of selected bolts 45*a*, 45*b*. Transversely extending, parallel end walls 28*a*, 28*b* connecting side walls 41*a*, 41*b* are disposed perpendicular thereto and are located longitudinally inward from ends 46 of side walls 41*a*, 41*b*. The bottom edges 47 of end walls 28*a*, 28*b* are substantially flush with the bottom edges 48 of side walls 41*a*, 41*b*, are the top edges 51 of end walls 28*a*, 28*b* are disposed below flanges 42*a*, 42*b* as shown in FIG. 2. End walls 28*a*, 28*b* have centrally formed apertures (not shown) for receiving bearings 27 in which shafts 24*a*, 24*b* are journaled.

In addition, each end wall 28*a*, 28*b* has a normally outwardly extending, internally threaded socket 52 located adjacent top edge 51 and side wall 41*a* for accepting a bolt 53 mounting a pivot block 54 between a washer 55 adjacent head 56 of bolt 53 and the outer end 57 of socket 52 with proper clearance maintained to allow pivot block 54 to pivot about bolt 53. Each end wall 28*a*, 28*b* also has a normally outwardly extending pin 58 located adjacent side wall 41*a* with its axis lying in the same horizontal plane as the axis of shafts 24*a*, 24*b*. Pin 58 serves as a fixed mounting post for one end of a brake band 61. Side wall 41*b* carries a pair of normally inwardly extending brackets 62 each having an aperture 63 formed longitudinally therethrough adjacent the end 64 thereof for accepting one end of a coiled spring 65 as shown in FIG. 2. Brackets 62 are located adjacent the outer side 66 of end walls 28*a*, 28*b* in alignment with pivot block 54 as shown in FIGS. 3 and 4. Each pivot block 54 has an aperture 67 formed therethrough adjacent the side 68 facing bracket 62 to accept the other end of coiled spring 65 so that spring 65 is maintained in tension parallel to end wall 28*a*, 28*b* and perpendicular to side walls 41*a*, 41*b*, biasing the bottom of pivot block 54 toward side wall 41*b*.

Carriage 31 also has a right angle mounting bracket 71 extending outwardly from side wall 41*a* having a top portion 72 located below and parallel to flange 42*a* and an end portion 73 perpendicular to side wall 41*a* and having its bottom edge 74 substantially flush with the bottom edge 48 of side wall 41*a*. End portion 73 has apertures formed therethrough in which are mounted bearings 76*a*, 76*b* in which shafts 77*a*, 77*b* are journaled. Motor 18 is mounted flush against one side 78 of end portion 73 with its drive shaft 77*a* journaled in bearing 76*a* and parallel to axle shafts 24*a*, 24*b* and having a drive sprocket 81 mounted thereon. Endless drive chain 22 is mounted on sprockets 21, 81 to transfer the rotational motion of the shaft 77*a* driven by motor 18 to sprocket 21 and axle shafts 24*a*, 24*b*. An idler sprocket 82*a* is mounted on shaft 77*b* and functions to take up slack in chain 22.

As shown in FIGS. 1, 2, and 3, the frame or chassis 82 of machine 10 is formed to provide parallel, identical, downwardly extending flanged portions 83*a*, 83*b* extending transversely between sides 84*a*, 84*b* and having flanges 85*a*, 85*b*. Angle brackets 86*a*, 86*b*, shorter than flanged portions 83*a*, 83*b* and having cut-out or recessed portions 87 in the flange portion 88 thereof are attached to the outside of flanged portions 83*a*, 83*b* as shown in FIG. 2 by welding or other suitable means. Brackets 86*a*, 86*b* extend contiguous with flanged portions 83*a*, 83*b* with clearance left between the ends 91 of angle brackets 86*a*, 86*b* and sides 84*a*, 84*b* of the machine. The upright portions 92, 93 of angle bracket 86*b* and flanged portion 83*b* respectively have corresponding apertures (not shown) for passage of brake lines 38 therethrough. Flanges 85*a*, 85*b* and 88 are parallel to one another and suitably spaced to form inwardly opening, opposing channels 94 having side walls 95*a*, 95*b* slidably receiving flanges 42*a*, 42*b* of carriage 31 with adequate clearance provided between the edges 96 of flanges 42*a*, 42*b* and side walls 95*a*, 95*b* to facilitate sliding insertion and removal of carriage 31 in channels 94.

Flanges 85*a*, 85*b* each have a pair of spaced, aligned apertures (not shown) formed therein to receive the shanks 44*a*, 44*b* of bolts 45*a*, 45*b*, the apertures positioned at locations responding generally to the central area of cutaway portions 87 of angle brackets 86*a*, 86*b* to thereby facilitate access to the bolt heads. As illustrated in FIG. 2, the bolts are shown only partially threaded into their respective nuts, and it will be appreciated that when fully tightened, the heads of the bolts bear against the undersurfaces of flanges 43 to bring flanges 43 into tight engagement with flanges 85*a* and 85*b*, to thereby secure the drive carriage assembly 30 with respect to frame or chassis 82. Cutaway portions 87 thus permit access to the heads of bolts 45*a*, 45*b* in order to permit them to be loosened when it is desired to remove drive carriage assembly 30 from floor cleaning machine 10.

As shown in FIGS. 2 and 3, each brake line 38 has a clevis 97 attached to the end thereof and pivotally connected to one of two identical pivot arms 98 which are pivotally mounted at a common pivot point P on a bracket 101 extending inwardly from flanged portion 83*b* of frame 82. Each pivot arm 98 has a ball 102 projecting perpendicularly downward from the underside 103 of its pivot arm 98 adjacent the end of the arm to which the clevis 97 is attached.

Each brake assembly also includes an adjustable, externally threaded connecting rod 104 having a socket 105 threaded on one end, socket 105 being adapted to receive ball 102 in releasable engagement therewith, this arrangement being of a type commonly known as a quick disconnect. A sleeve 106 threaded on the other end of connecting rod 104 has a pin 107 protruding therefrom on an axis in a horizontal plane parallel to the horizontal plane in which the pivot point PP of pivot block 54 is disposed. Pivot block 54 has an aperture 108 formed therethrough adjacent its top edge 111 for pivotal connection with pin 107. Block 54 also has a pin 112 projecting outwardly therefrom on which is mounted the other end 113 of brake band 61. When the operator of the machine wishes to apply either of the brakes, actuation of the corresponding cable 114 carried in lines 38 causes the corresponding pivot arm 98 to pivot about point P toward flanged portion 83*b*, pulling connecting rod 104 toward flanged portion 83*b*. This causes pivot block 54 to pivot about point PP, drawing top end 111 toward flanged portion 83*b* and forcing bottom end 115 toward side wall 41*a*, extending spring 65 and causing brake band 61 to engage the corresponding brake drum 116.

Each wheel 13 is removably mounted on its hub 25 by means of four bolts 117 inserted through apertures in wheel 13 into corresponding threaded sockets (not shown) in hubs 25. A pair of skirts 118 are provided for protectively enclosing removable drive carriage 31 within the frame 82 of machine 10. Skirts 118 are removably attached on opposite sides 84*a*, 84*b* of frame 82 by means of bolts 121 or other suitable fasteners.

To remove drive carriage assembly 30 from its operating position in machine 10, skirts 118 are removed from the machine and wheel assemblies 13 are removed from hubs 25, as shown in FIG. 4. Machine 10 is lifted to provide clearance for wheel removal. Bolts 45*a* are loosened and bolts 45*b* are removed. Power cables 32, 35 are disconnected, and the brake assembly disconnects 37 are released. The entire drive carriage assembly 30 then can be removed by simply sliding the same outwardly, laterally of machine 10, until assembly 30 is completely free of the machine.

The entire drive train now is exposed and accessible for inspection, maintenance, replacement and repair, as may be necessary, all without having to tip the machine over, or hoisting the machine to an elevation permitting working beneath the machine, and avoids having to attempt to work on the drive train while it is in position on the machine. If it is determined that the drive train should be moved to another location, such as a repair shop, that can be done and a substitute drive carriage assembly inserted in the machine which then can go back into immediate service while the necessary work is being done on the original drive train.

Thus, with this invention there is no prolonged down time because of the need to work on the drive train, and such work is greatly facilitated by the ready removability and thereafter total accessibility of the drive carriage and train.

The drive carriage assembly is inserted into its operative position on the machine by reversing the procedure for removal. Thus, the flanges 42*a*, 42*b* are positioned in the channels 94 and the carriage slide inwardly until the shanks of bolts 45*a* engage the inner ends 126 of the slots 43 at the flange ends 125. Then, bolts 45*a* are tightened, bolts 45*b* are replaced and tightened, the power cables 32, 35 are connected and the brake assembly disconnects 37 engaged. Wheel assemblies 13 are secured on hubs 25, at which point the machine is ready to go back into service, the skirts 118 being replaced to complete the reassembly.

In the illustrated embodiment, the slots 43 at the opposite ends 127 of flanges 42*a*, 42*b* also are open ended, and in the absence of other obstructions on the machine the drive carriage assembly can be removed by sliding the same laterally outwardly from either side of the machine. If, because of other factors, there is an obstruction preventing removal from one side, then the drive carriage assembly is simply removed from the side which is free of obstruction.

It can be seen from the preceding description of an illustrative embodiment that the present invention accomplishes its intended objects. While this invention has been described by reference to a specific embodiment, it is not to be limited thereto, for obvious modifications will occur to those skilled in the art without departing from the scope of this invention.

We claim:

1. An improved floor cleaning machine of the type having a power source, propulsion means connected to said power source including detachable drive wheels for tracking on the floor surface to be cleaned, scrubber means for wetting and cleaning the floor surface, means including a wiper for drying the cleaned surface, and control means operatively associated with said propulsion means, scrubber means and drying means for controlling actuation of said machine, said machine having a normal operating position, wherein the improvement comprises:

(a) said propulsion means being mounted on a removable carriage which is removably secured to said machine, said carriage being removable from said machine while the latter is in said normal operating position;

(b) said machine having a frame, said carriage being removably secured to said machine frame; and (c) wherein said carriage is slidably supported on said frame.

2. The machine of claim 1, wherein said propulsion means comprises a drive motor operatively connected to a drive axle assembly, said drive wheels being mounted on said axle assembly, together with brake means mounted on said carriage in operative association with said drive wheels.

3. The machine of claim 2, wherein said drive motor is detachably connected to said power source, said brake means being detachably connected to said control means.

4. The machine of claim 3, wherein said drive motor is disconnected from said power source, said drive wheels are disconnected from said axle assembly and said brake means are disconnected from said control means prior to removing said carriage from said machine.

5. The machine of claim 1, wherein said frame comprises a pair of channels, said carriage having flange means slidably supported by said channels for suspending said carriage therefrom.

6. The machine of claim 1, said carriage being slidably removable from said frame along a predetermined path, said machine having a skirt removably positioned across said path.

7. In a self-propelled floor cleaning machine including means to apply cleaning fluids to floor surfaces in predetermined quantities, scrubbing means to forcibly bring said cleaning fluids into intimate contact with said floor surfaces, and means to remove said cleaning fluids from said floor after the same has been scrubbed, said machine including a chassis rotatably supporting a pair of drive wheels and a propulsion system carried by said chassis and adapted to power said drive wheels, said propulsion system including a drive motor and means to transmit power from said motor to said drive wheels, the improvement comprising a carriage assembly on which said propulsion system is mounted, said carriage assembly including a pair of spaced, outwardly extending flanges, said chassis including a pair of spaced, opposed flanges cooperable with said carriage assembly flanges to permit said carriage assembly flanges to be slidably received by said chassis flanges, and means for securing said carriage assembly in a predetermined position.

8. The floor cleaning machine of claim 7 wherein said outwardly extending flanges extend from said carriage assembly, and said chassis flanges form a pair of spaced, opposed, channels.

9. The floor cleaning machine of claim 8 wherein said channels and said flanges are oriented in a direction substantially perpendicular to the path of travel of said machine, whereby to permit said propulsion system to be removed from a side thereof.

* * * * *